US010540939B2

(12) United States Patent
Seo et al.

(10) Patent No.: US 10,540,939 B2
(45) Date of Patent: Jan. 21, 2020

(54) DISPLAY APPARATUS AND A METHOD OF DRIVING THE SAME

(71) Applicant: SAMSUNG DISPLAY CO., LTD., Yongin-si, Gyeonggi-do (KR)

(72) Inventors: Jimyoung Seo, Hwaseong-si (KR); Kyoungwon Lee, Seoul (KR); Silyi Bang, Yongin-si (KR); Kwan-Young Oh, Hanam-si (KR); Junghwan Cho, Asan-si (KR); Sangsu Han, Hanam-si (KR); Sangmi Kim, Yongin-si (KR); Jang-Hyun Yeo, Seoul (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 163 days.

(21) Appl. No.: 15/598,459

(22) Filed: May 18, 2017

(65) Prior Publication Data

US 2017/0345386 A1 Nov. 30, 2017

(30) Foreign Application Priority Data

May 24, 2016 (KR) ..... 10-2016-0063617

(51) Int. Cl.
*G09G 3/36* (2006.01)

(52) U.S. Cl.
CPC ..... *G09G 3/3696* (2013.01)

(58) Field of Classification Search
CPC . G09G 3/3696; G09G 3/3611; G09G 2370/08
See application file for complete search history.

(56) References Cited

U.S. PATENT DOCUMENTS 5,771,040 A * 6/1998 Kim ..... G09G 3/3611 345/213
6,320,575 B1 * 11/2001 Terashima ..... G09G 3/20 345/213

(Continued)

FOREIGN PATENT DOCUMENTS

| | | |
|---|---|---|
| KR | 1020090123290 | 12/2009 |
| KR | 1020150025104 | 3/2015 |
| KR | 1020150082816 | 7/2015 |

OTHER PUBLICATIONS

Tsuruma, Takeyuki et al., "Novel Image Sticking Model in the Fringe Field Switching Mode Based on the Flexoelectric Effect", 31st, International Display Research Conference; 2011; Arcachon, France, pp. 1-4.

*Primary Examiner* — Grant Sitta
(74) *Attorney, Agent, or Firm* — F. Chau & Associates, LLC

(57) ABSTRACT

A display apparatus includes a display panel to display an image, a first frame counter to count a first number of frames during a first duration and to be reset when the first number reaches a first reference number, a second frame counter to count a second number of the frames during a second duration and to be reset when the second number reaches a second reference number, wherein the second duration occurs after and is shorter than the first duration, a level counter to hold a count value at a first count value during the first duration, to change the count value when the first frame counter is reset, and to change the count value when the second frame counter is reset, and a common voltage generator to control a level of a common voltage to correspond to the count value and to output the common voltage.

20 Claims, 6 Drawing Sheets

(56) References Cited

U.S. PATENT DOCUMENTS

2002/0140462 A1* 10/2002 Ichihara ..... G09G 3/3611 327/99
2006/0244704 A1* 11/2006 JaeHun ..... G09G 3/3655 345/92
2006/0279505 A1* 12/2006 Nagato ..... G09G 3/3611 345/98
2007/0002005 A1* 1/2007 Kim ..... G09G 3/3655 345/103
2007/0164969 A1* 7/2007 Kim ..... G09G 3/3611 345/99
2008/0192072 A1* 8/2008 Park ..... G09G 3/3611 345/690
2009/0002292 A1* 1/2009 Koo ..... G09G 3/3611 345/87
2009/0015528 A1* 1/2009 Sheu ..... G09G 3/3655 345/87
2009/0284456 A1* 11/2009 Song ..... G09G 3/3655 345/94
2011/0205439 A1* 8/2011 Iisaka ..... G09G 3/2096 348/607
2012/0162184 A1* 6/2012 Kim ..... G09G 3/3655 345/212
2013/0278585 A1* 10/2013 Moon ..... G09G 3/36 345/212
2013/0314393 A1* 11/2013 Min ..... G09G 3/36 345/212
2015/0194122 A1 7/2015 Kim et al.
2016/0005345 A1* 1/2016 Kubo ..... H03K 5/1252 345/214
2016/0049133 A1* 2/2016 Park ..... G09G 3/3648 345/212
2016/0125832 A1* 5/2016 Hwang ..... G09G 3/3696 345/212
2016/0365058 A1* 12/2016 Nam ..... G09G 3/3688

* cited by examiner

DISPLAY APPARATUS AND A METHOD OF DRIVING THE SAME

CROSS-REFERENCE TO RELATED APPLICATION

This application claims priority under 35 U.S.C. § 119 to Korean Patent Application No. 10-2016-0063617, filed on May 24, 2016 in the Korean Intellectual Property Office (KIPO), the disclosure of which is incorporated by reference herein in its entirety.

TECHNICAL FIELD

Exemplary embodiments of the present inventive concept relate generally to display devices, and more particularly, to display apparatuses and methods of driving the display apparatuses.

DESCRIPTION OF THE RELATED ART

Generally, a liquid crystal display ("LCD") apparatus includes a first substrate including a pixel electrode, a second substrate including a common electrode and a liquid crystal layer disposed between the first and second substrates. An electric field is generated by voltages applied to the pixel electrode and the common electrode. By adjusting an intensity of the electric field, a transmittance of light passing through the liquid crystal layer may be adjusted so that an image may be displayed.

The LCD apparatus also includes a display panel and a panel driver. The display panel includes a plurality of gate lines, a plurality of data lines and a plurality of pixels connected to the gate lines and the data lines. The panel driver includes a gate driver for providing gate signals to the gate lines and a data driver for providing data voltages to the data lines.

An afterimage may appear on a screen when a common voltage applied to the common electrode has a constant level.

SUMMARY

A display apparatus according to an exemplary embodiment of the present inventive concept includes a display panel configured to display an image, a first frame counter configured to count a first number of frames during a first duration and to be reset when the first number of the frames reaches a first reference number, a second frame counter configured to count a second number of the frames during a second duration and to be reset when the second number of the frames reaches a second reference number, wherein the second duration occurs after the first duration and is shorter than the first duration. The display apparatus further includes a level counter configured to hold a count value at a first count value during the first duration, to change the count value when the first frame counter is reset, and to change the count value when the second frame counter is reset, and a common voltage generator configured to control a level of a common voltage to correspond to the count value and to output the common voltage to the display panel.

In an exemplary embodiment of the present inventive concept, the first frame counter and the second frame counter operate alternately.

In an exemplary embodiment of the present inventive concept, the first duration ends and the second duration begins when the first frame counter is reset.

In an exemplary embodiment of the present inventive concept, the second duration ends when the count value reaches a limit count value during the second duration.

In an exemplary embodiment of the present inventive concept, the level counter is configured to increase the count value when the second frame counter is reset during the second duration if the level counter increased the count value when the first frame counter was reset, and decrease the count value when the second frame counter is reset during the second duration if the level counter decreased the count value when the first frame counter was reset.

In an exemplary embodiment of the present inventive concept, the first and second frame counters are configured to count a number of the frames in response to a vertical start signal.

In an exemplary embodiment of the present inventive concept, the display apparatus further comprises a frame count signal generator configured to generate a frame count signal in response to a data enable signal or a gate clock signal, wherein the first and second frame counters are configured to count a number of the frames in response to the frame count signal.

In an exemplary embodiment of the present inventive concept, the first frame counter is configured to count a third number of the frames during a third duration which occurs after the second duration and to be reset when the third number of the frames reaches the first reference number, wherein the second frame counter is configured to count a fourth number of the frames during a fourth duration which occurs after the third duration and to be reset when the fourth number of the frames reaches the second reference number, and wherein the level counter is configured to hold the count value at a second count value during the third duration and to change the count value when the second frame counter is reset during the fourth duration.

In an exemplary embodiment of the present inventive concept, the level counter is configured to decrease the count value when the first frame counter is reset during the third duration if the level counter increased the count value when the first frame counter was reset during the first duration, and increase the count value when the first frame counter is reset during the third duration if the level counter decreased the count value when the first frame counter was reset during the first duration.

In an exemplary embodiment of the present inventive concept, the second duration ends when the count value reaches the second count value during the second duration, and the fourth duration ends when the count value reaches the first count value during the fourth duration.

In an exemplary embodiment of the present inventive concept, the level counter is configured to change the count value during vertical blank durations between the frames.

In an exemplary embodiment of the present inventive concept, the first duration is more than two times longer than the second duration.

In an exemplary embodiment of the present inventive concept, the display apparatus further comprises a mode controller configured to select one of a first mode and a second mode, wherein the level of the common voltage is held or changed according to an operation of the level counter in the first mode, and the common voltage has a reference common voltage level in the second mode.

In an exemplary embodiment of the present inventive concept, the display apparatus further comprises a data driver configured to generate data voltages in response to input image data, wherein the display panel comprises a pixel electrode and a common electrode, wherein the data driver is configured to output the data voltages to the pixel electrode, and wherein the common voltage generator is configured to output the common voltage to the common electrode.

A method of driving a display apparatus according to an exemplary embodiment of the present inventive concept includes outputting a data voltage in response to input image data, counting a first number of frames and holding a count value at a first count value, resetting counting of the first number of the frames and changing the count value when the first number of the frames reaches a first reference number, counting a second number of the frames when the counting of the first number of the frames is reset and resetting counting of the second number of the frames when the second number of the frames reaches a second reference number, changing the count value when the counting of the second number of the frames is reset, and controlling a level of a common voltage to correspond to the count value and outputting the common voltage.

In an exemplary embodiment of the present inventive concept, changing the count value when the counting of the second number of the frames is reset comprises increasing the count value when the counting of the second number of the frames is reset if the count value was increased when the counting of the first number of the frames was reset, and decreasing the count value when the counting of the second number of the frames is reset if the count value was decreased when the counting of the first number of the frames was reset.

In an exemplary embodiment of the present inventive concept, counting the first and second numbers of the frames comprises counting the first and second numbers of the frames in response to a vertical start signal.

In an exemplary embodiment of the present inventive concept, counting the first and second numbers of the frames comprises generating a frame count signal in response to a data enable signal or a gate clock signal, and counting the first and second numbers of the frames in response to the frame count signal.

A method of driving a display apparatus according to an exemplary embodiment of the present inventive concept includes outputting a data voltage in response to input image data, holding a level of a common voltage at a first voltage level while a first frame counter counts a number of frames up to a first reference number during a first duration, changing the level of the common voltage to a second voltage level during a second duration which occurs after the first duration, and holding the level of the common voltage at the second voltage level while the first frame counter counts the number of the frames up to the first reference number during a third duration which occurs after the second duration.

In an exemplary embodiment of the present inventive concept, changing the level of the common voltage comprises resetting a second frame counter and changing the level of the common voltage by one step when the second frame counter counts the number of the frames up to a second reference number during the second duration.

BRIEF DESCRIPTION OF THE DRAWINGS

The above and other features of the present inventive concept will become more apparent by describing in detail exemplary embodiments thereof with reference to the accompanying drawings, in which.

DETAILED DESCRIPTION OF EMBODIMENTS

Hereinafter, exemplary embodiments of the present inventive concept will be explained in detail with reference to the accompanying drawings.

Figure 1:
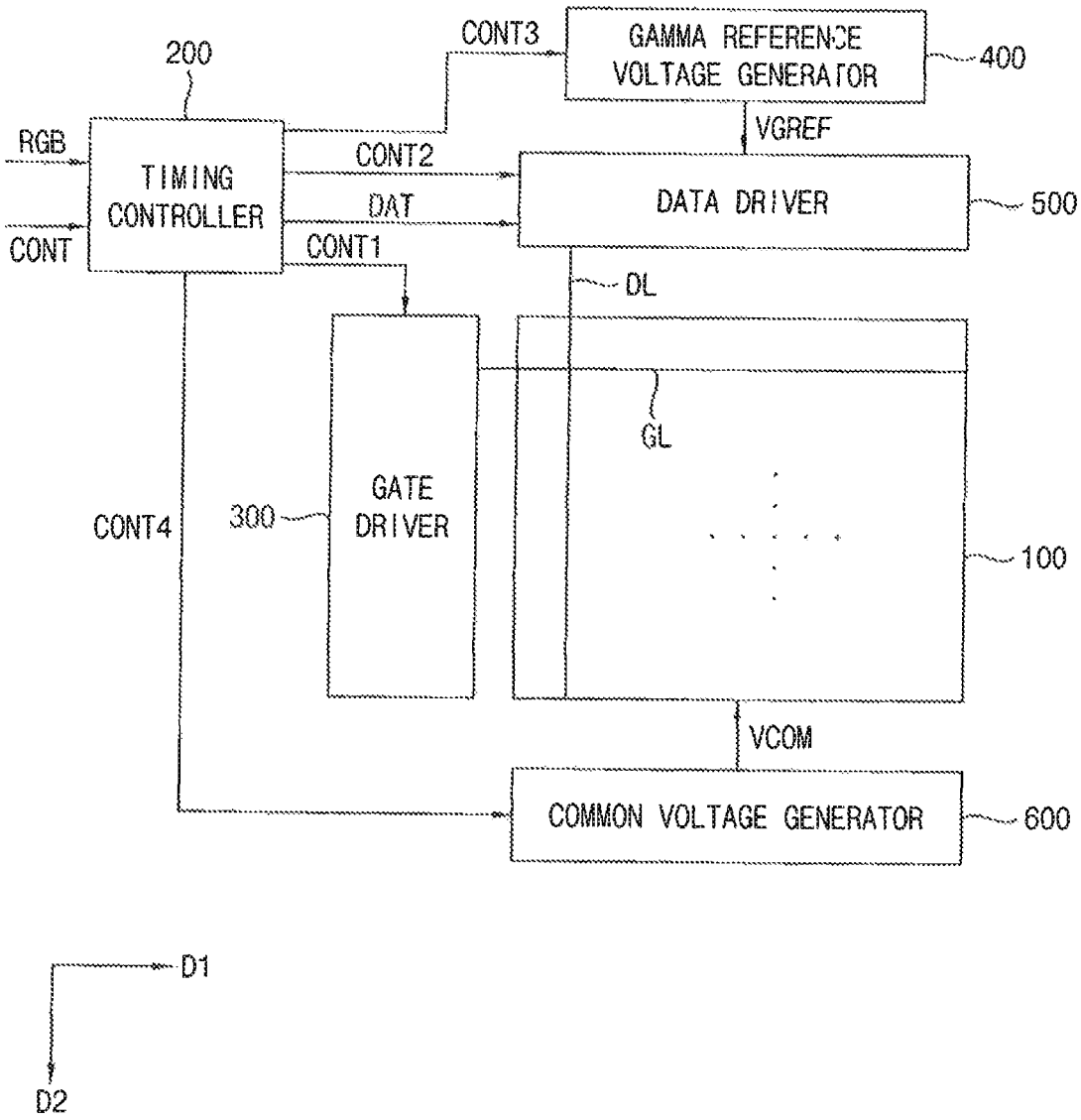
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus includes a display panel 100 and a panel driver. The panel driver includes a timing controller 200, a gate driver 300, a gamma reference voltage generator 400, a data driver 500 and a common voltage generator 600.

The display panel 100 may include a first substrate including a pixel electrode, a second substrate including a common electrode and a liquid crystal layer disposed between the first and second substrates.

The display panel 100 includes a display region for displaying an image and a peripheral region adjacent to the display region.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1.

In an exemplary embodiment of the present inventive concept, the pixels may include a switching element, a liquid crystal capacitor and a storage capacitor. The liquid crystal capacitor and the storage capacitor may be electrically connected to the switching element. The pixels may be arranged in a matrix configuration.

The timing controller 200 receives input image data RGB and an input control signal CONT from an external device. The input image data RGB may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3, a fourth control signal CONT4 and a data signal DAT based on (or in response to) the input image data RGB and the input control signal CONT.

The timing controller 200 generates the first control signal CONT1 for controlling operations of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling operations of the data driver 500 based on the input control signal CONT, and outputs the second control signal CONT2 to the data driver 500. The second control signal CONT2 may include a horizontal start signal and a load signal.

The timing controller 200 generates the data signal DAT based on the input image data RGB. The timing controller 200 outputs the data signal DAT to the data driver 500. The data signal DAT may be substantially the same image data as the input image data RGB or the data signal DAT may be compensated image data generated by compensating the input image data RGB. For example, the timing controller 200 may perform an image quality compensation, a spot compensation, an adaptive color correction (ACC), and/or a dynamic capacitance compensation (DCC) on the input image data RGB to generate the data signal DAT.

The timing controller 200 generates the third control signal CONT3 for controlling operations of the gamma reference voltage generator 400 based on the input control signal CONT, and outputs the third control signal CONT3 to the gamma reference voltage generator 400.

The timing controller 200 generates the fourth control signal CONT4 for controlling operations of the common voltage generator 600 based on the input control signal CONT, and outputs the fourth control signal CONT4 to the common voltage generator 600.

The timing controller 200 will be explained in detail with reference to FIG. 2.

The gate driver 300 generates gate signals for driving the gate lines GL in response to the first control signal CONT1 received from the timing controller 200. The gate driver 300 sequentially outputs the gate signals to the gate lines GL.

In an exemplary embodiment of the present inventive concept, the gate driver 300 may be directly mounted on the display panel 100, or may be connected to the display panel 100 as a tape carrier package (TCP) type. Additionally, the gate driver 300 may be integrated on the peripheral region of the display panel 100.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of a plurality of pixel data included in the data signal DAT.

In an exemplary embodiment of the present inventive concept, the gamma reference voltage generator 400 may be disposed in the timing controller 200, or may be disposed in the data driver 500.

The data driver 500 receives the second control signal CONT2 and the data signal DAT from the timing controller 200, and receives the gamma reference voltage VGREF from the gamma reference voltage generator 400. The data driver 500 converts the data signal DAT to data voltages having analog levels based on the gamma reference voltage VGREF. The data driver 500 outputs the data voltages to the data lines DL.

In an exemplary embodiment of the present inventive concept, the data driver 500 may be directly mounted on the display panel 100, or may be connected to the display panel 100 as a TCP type. Additionally, the data driver 500 may be integrated on the peripheral region of the display panel 100.

The common voltage generator 600 receives the fourth control signal CONT4 from the timing controller 200. The common voltage generator 600 generates a common voltage VCOM based on the fourth control signal CONT4. The fourth control signal CONT4 may include information about a level of the common voltage VCOM. For example, the common voltage generator 600 may generate the common voltage VCOM having a level corresponding to a level of the fourth control signal CONT4. The common voltage generator 600 outputs the common voltage VCOM to the common electrode of the display panel 100.

The operations of the common voltage generator 600 will be explained in detail with reference to FIG. 6.

Figure 2:
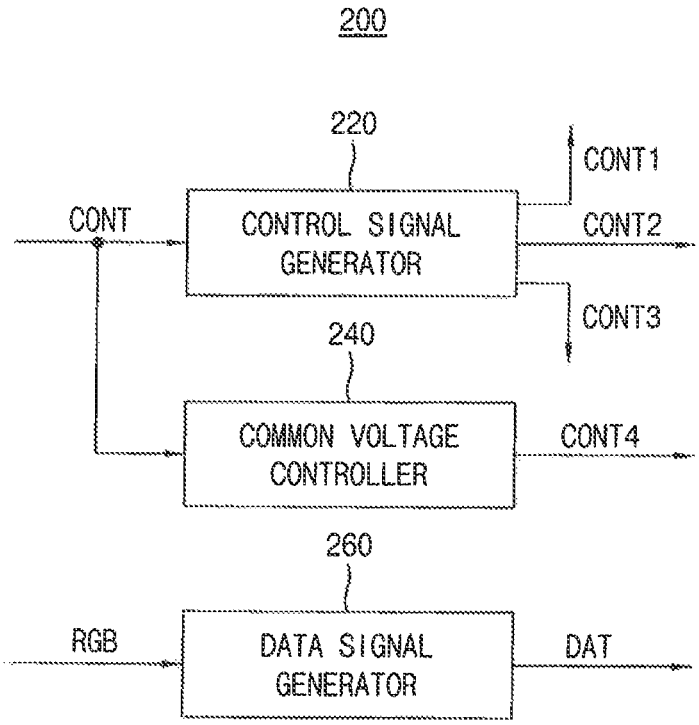
FIG. 2 is a block diagram illustrating a timing controller included in a display apparatus according to an exemplary embodiment of the present inventive concept.

FIG. 2 is a block diagram illustrating a timing controller included in a display apparatus according to an exemplary embodiment of the present inventive concept.

Referring to FIGS. 1 and 2, the timing controller 200 includes a control signal generator 220, a common voltage controller 240 and a data signal generator 260.

The control signal generator 220 generates the first through third control signals CONT1, CONT2, CONT3 based on the input control signal CONT. The control signal generator 220 outputs the first control signal CONT1 to the gate driver 300. The first control signal CONT1 may include the vertical start signal and the gate clock signal. The control signal generator 220 may output the vertical start signal and the gate clock signal to the common voltage controller 240. The control signal generator 220 outputs the second control signal CONT2 to the data driver 500. The control signal generator 220 outputs the third control signal CONT3 to the gamma reference voltage generator 400.

The common voltage generator 240 may generate the fourth control signal CONT4 based on the input control signal CONT. Additionally, the common voltage generator 240 may generate the fourth control signal CONT4 based on the vertical start signal and the gate clock signal. The fourth control signal CONT4 may control a level and a timing of the common voltage VCOM.

The common voltage generator 240 will be explained in detail with reference to FIGS. 3, 4A through 4C, 5 and 6.

The data signal generator 260 generates the data signal DAT based on the input image data RGB. The data signal generator 260 outputs the data signal DAT to the data driver 500.

Figure 3:
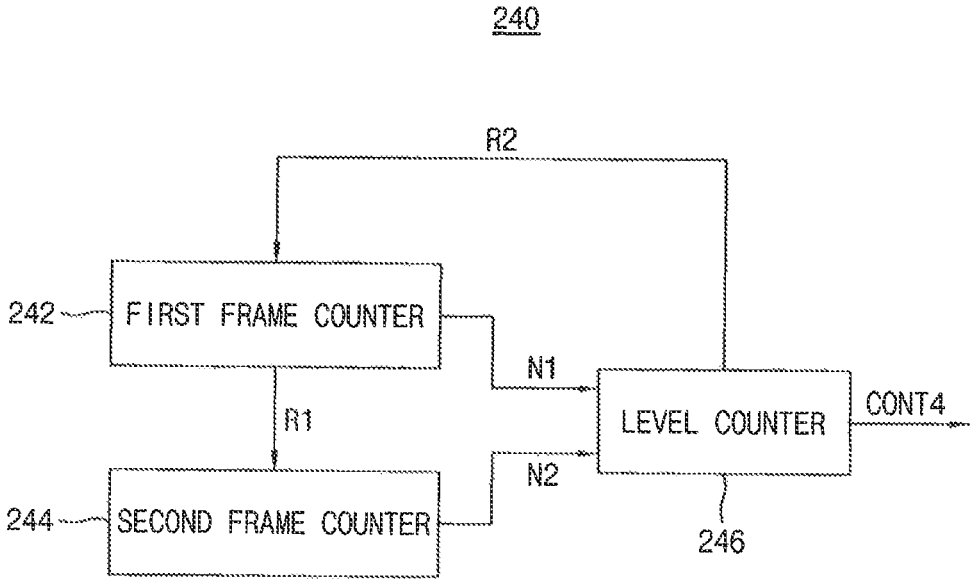
FIG. 3 is a block diagram illustrating a common voltage controller included in a display apparatus according to an exemplary embodiment of the present inventive concept.

FIG. 3 is a block diagram illustrating a common voltage controller included in a display apparatus according to an exemplary embodiment of the present inventive concept.

Referring to FIGS. 1 through 3, the common voltage controller 240 includes a first frame counter 242, a second frame counter 244 and a level counter 246.

The first frame counter 242 and the second frame counter 244 operate alternately. For example, the second frame counter 244 may maintain a reset status while the first frame counter 242 counts a number of frames, and the first frame counter 242 may maintain a reset status while the second frame counter 244 counts a number of the frames.

The first frame counter 242 counts a first number N1 of the frames during a common voltage holding duration. The first frame counter 242 counts the first number N1 of the frames until the first number N1 reaches a first reference number.

The level counter 246 holds a count value at a first count value during the common voltage holding duration. In other words, the level counter 246 holds the count value at the first count value while the first frame counter 242 counts the first number N1 of the frames.

The first frame counter 242 is reset when the first number N1 of the frames reaches the first reference number. The common voltage holding duration ends and a common voltage changing duration begins when the first frame counter 242 is reset. The first frame counter 242 maintains the reset status during the common voltage changing duration. The first frame counter 242 outputs a first reset signal R1 to the second frame counter 244 when the first frame counter 242 is reset.

The level counter 246 changes the count value when the first frame counter 242 is reset. For example, the level counter 246 may increase the count value when the first frame counter 242 is reset. Alternatively, the level counter 246 may decrease the count value when the first frame counter 242 is reset.

The common voltage changing duration begins when the second frame counter 244 receives the first reset signal R1. The second frame counter 244 counts a second number N2 of the frames during the common voltage changing duration. The second frame counter 244 counts the second number N2 of the frames until the second number N2 reaches a second reference number.

The level counter 246 holds the count value while the second frame counter 244 counts the second number N2 of the frames.

The second frame counter 244 is reset when the second number N2 of the frames reaches the second reference number during the common voltage changing duration. In other words, the second frame counter 244 is reset every time the second number N2 of the frames reaches the second reference number during the common voltage changing duration. The second frame counter 244 starts to count the second number N2 of the frames again when the second frame counter 244 is reset.

The level counter 246 changes the count value when the second frame counter 244 is reset. For example, the level counter 246 may increase the count value when the second frame counter 244 is reset. Alternatively, the level counter 246 may decrease the count value when the second frame counter 244 is reset.

For example, the lever counter 246 may increase the count value when the second frame counter 244 is reset during a first common voltage changing duration subsequent to a first common voltage holding duration if the first frame counter 242 increased the count value when it was reset during the first common voltage holding duration. In this case, the level counter 246 may decrease the count value when the first frame counter 242 is reset during a second common voltage holding duration subsequent to the first common voltage changing duration.

Alternatively, the lever counter 246 may decrease the count value when the second frame counter 244 is reset during the first common voltage changing duration if the first frame counter 242 decreased the count value when it was reset during the first common voltage holding duration. In this case, the level counter 246 may increase the count value when the first frame counter 242 is reset during the second common voltage holding duration subsequent to the first common voltage changing duration.

The common voltage changing duration ends and the common voltage holding duration begins when the count value reaches a limit count value. The second frame counter 244 maintains the reset status during the common voltage holding duration. The level counter 246 outputs a second reset signal R2 to the first frame counter 242 when the count value reaches the limit count value.

The common voltage holing duration begins and the first frame counter 242 starts to count the first number N1 of the frames when the first frame counter 242 receives the second reset signal R2. Hereinafter, the aforementioned steps are repeated.

The level counter 246 may change the count value during vertical blank durations between each frame. In other words, the level counter 246 may change the count value while the data voltages are not output.

The common voltage holing duration and the common voltage changing duration alternate. In other words, the common voltage holding duration may occur, and then, the common voltage charging duration may occur in repeated fashion.

The level counter 246 may generate the fourth control signal CONT4 based on the held or changed count value and may output the fourth control signal CONT4 to the common voltage generator 600.

The common voltage generator 600 controls the level of the common voltage VCOM to correspond to the count value and outputs the common voltage VCOM to the common electrode.

The common voltage VCOM will be explained in detail with reference to FIG. 6.

Figure 4A:
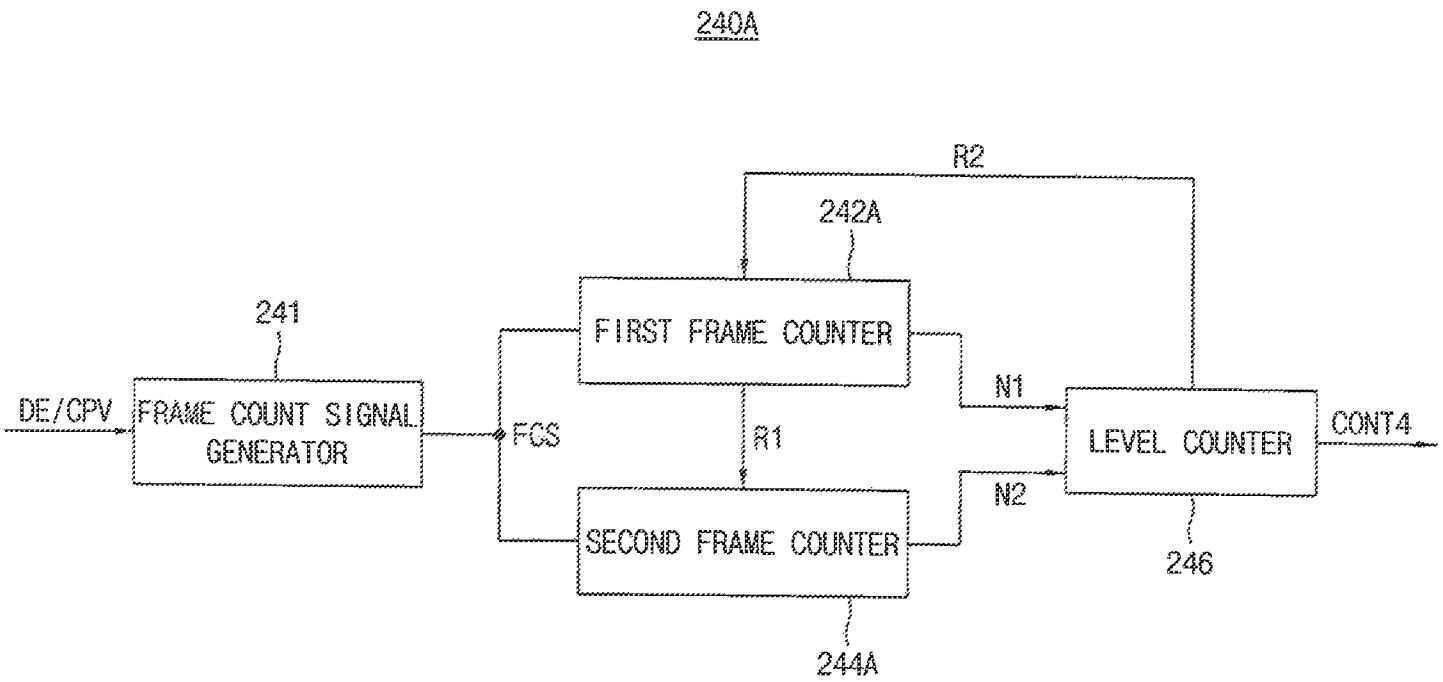
FIG. 4A is a block diagram illustrating a common voltage controller included in a display apparatus according to an exemplary embodiment of the present inventive concept.
Figure 4B:
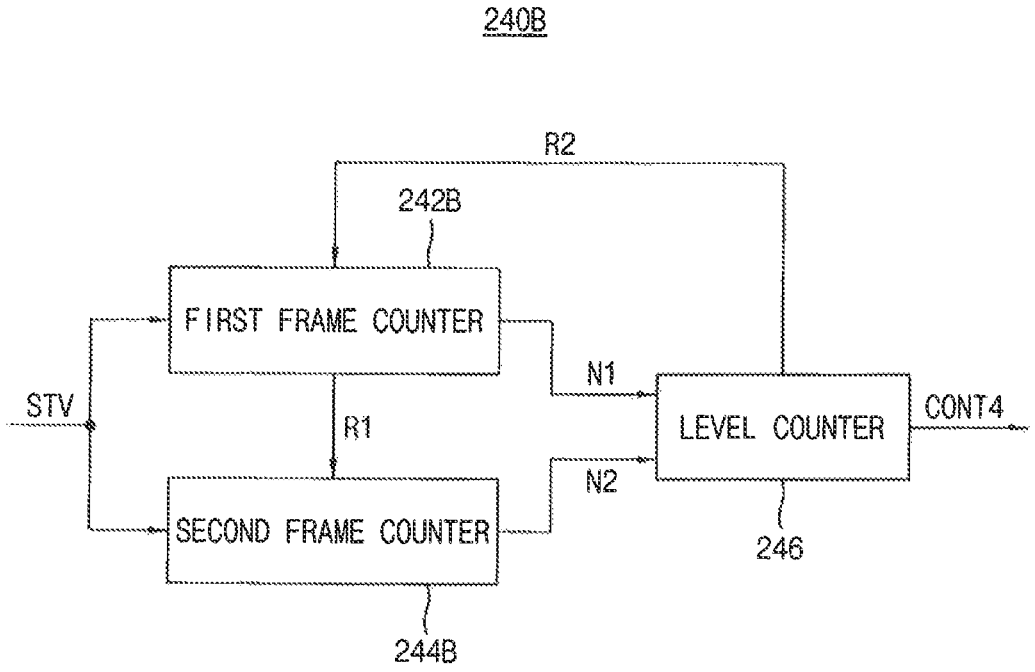
FIG. 4B is a block diagram illustrating a common voltage controller included in a display apparatus according to an exemplary embodiment of the present inventive concept.
Figure 4C:
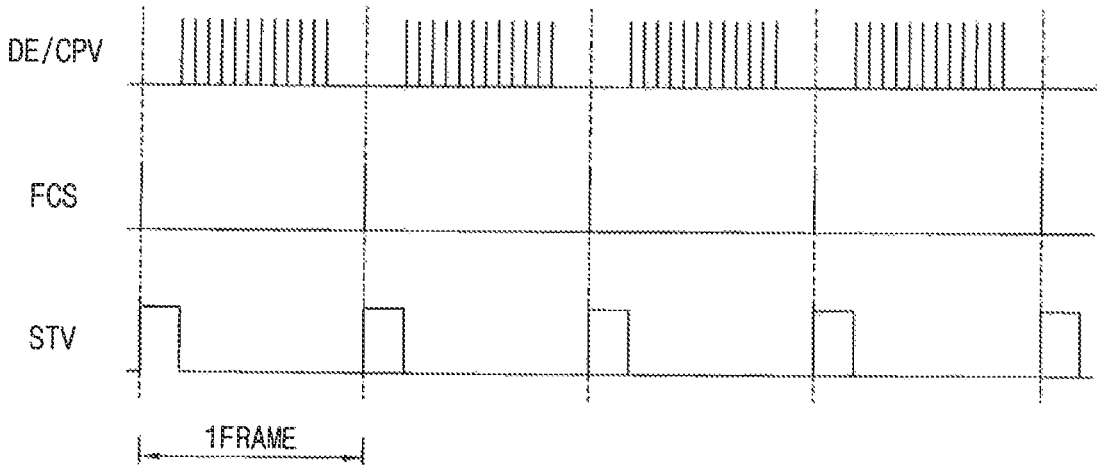
FIG. 4C is a timing diagram illustrating signals received by or output from a common voltage controller illustrated in FIGS. 4A and 4B according to an exemplary embodiment of the present inventive concept.

FIG. 4A is a block diagram illustrating a common voltage controller included in a display apparatus according to an exemplary embodiment of the present inventive concept. FIG. 4B is a block diagram illustrating a common voltage controller included in a display apparatus according to an exemplary embodiment of the present inventive concept. FIG. 4C is a timing diagram illustrating signals received by or output from a common voltage controller illustrated in FIGS. 4A and 4B according to an exemplary embodiment of the present inventive concept. Hereinafter, any repetitive explanation made with reference to FIG. 3 may be omitted.

Referring to FIGS. 1, 3 and 4C, the input control signal CONT may include a data enable signal DE. The first control signal CONT1 may include a gate clock signal CPV. The data enable signal DE and the gate clock signal CPV toggle periodically. The data enable signal DE and the gate clock signal CPV can be used to count a number of frames.

The first control signal CONT1 may further include a vertical start signal STV. The vertical start signal STV has a pulse for each frame. In other words, one pulse per frame. The vertical start signal STV can be used to count the number of the frames.

Referring to FIGS. 1, 3, 4A and 4C, a common voltage controller 240A may further include a frame count signal generator 241.

The frame count signal generator 241 may generate a frame count signal FCS based on the data enable signal DE or the gate clock signal CPV. The frame count signal FCS may have a pulse for each frame. In other words, one pulse per frame. The frame count signal generator 241 may output the frame count signal FCS to first and second frame counters 242A, 244A. As shown in FIG. 4C, the pulse of the frame count signal FCS is shorter in time than the pulse of the vertical start signal STV. However, the present inventive concept is not limited thereto.

The first and second frame counters 242A, 244A may count the first and second numbers N1, N2 respectively based on the frame count signal FCS.

Referring to FIGS. 1, 3, 4B and 4C, first and second frame counters 242B, 244B may receive the vertical start signal STV.

The first and second frame counters 242B, 244B may count the first and second numbers N1, N2 respectively based on the vertical start signal STV.

Figure 5:
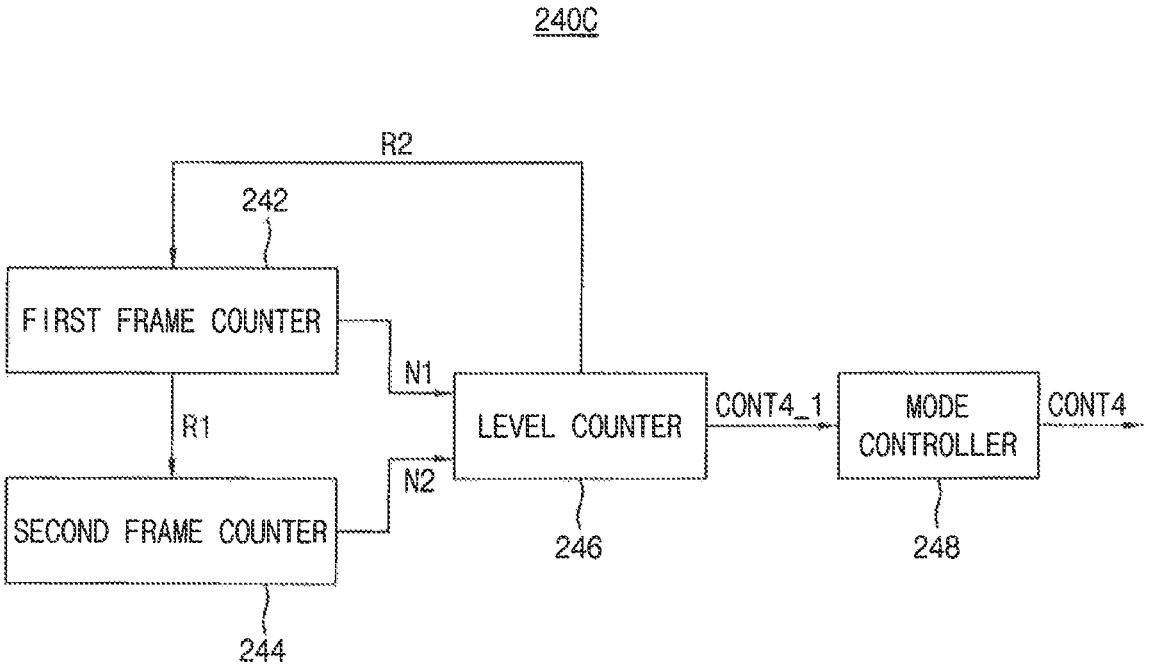
FIG. 5 is a block diagram illustrating a common voltage controller included in a display apparatus according to an exemplary embodiment of the present inventive concept.

FIG. 5 is a block diagram illustrating a common voltage controller included in a display apparatus according to an exemplary embodiment of the present inventive concept. Hereinafter, any repetitive explanation made with reference to FIG. 3 may be omitted.

Referring to FIGS. 1, 3 and 5, a common voltage controller 240C may further include a mode controller 248.

The level counter 246 may generate a fourth preliminary control signal CONT4_1 based on the held or changed count value and output the fourth preliminary control signal CONT4_1 to the mode controller 248.

The mode controller 248 may select one of a first mode and a second mode. A level of the common voltage VCOM is controlled based on the fourth preliminary control signal CONT4_1 in the first mode. The level of the common voltage VCOM is held regardless of the fourth preliminary control signal CONT4_1 in the second mode. In other words, even if the fourth preliminary control signal CONT4_1 is provided to the mode controller 248 in the second mode, the level of the common voltage VCOM will be held.

The mode controller 248 outputs the fourth preliminary control signal CONT4_1 as the fourth control signal CONT4 to the common voltage generator 600 when the mode controller 248 selects the first mode.

The mode controller 248 outputs the fourth control signal CONT4 to the common voltage generator 600 so that the level of the common voltage VCOM is held when the mode controller 248 selects the second mode.

Figure 6:
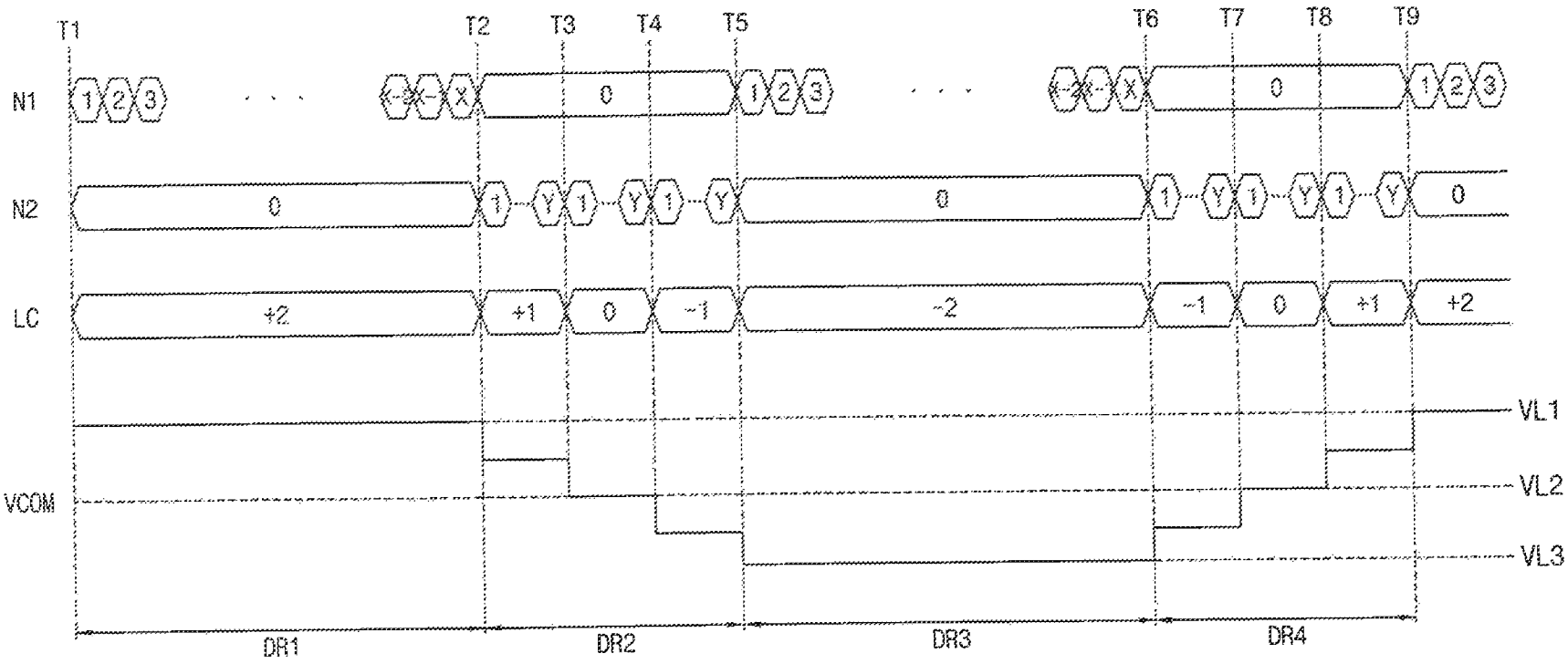
FIG. 6 is a timing diagram illustrating signals received by or output from a display apparatus according to an exemplary embodiment of the present inventive concept.

FIG. 6 is a timing diagram illustrating signals received by or output from a display apparatus according to an exemplary embodiment of the present inventive concept.

Referring to FIGS. 1, 3 and 6, first and third durations DR1, DR3 are common voltage holding durations and second and fourth durations DR2, DR4 are common voltage changing durations.

The first frame counter 242 starts to count the first number N1 of the frames at a first timing T1 when the first duration DR1 begins. The first frame counter 242 counts the first number N1 of the frames until the first number N1 reaches a first reference number X. The level counter 246 holds the count value LC at +2 during the first duration DR1.

The first frame counter 242 is reset at a second timing T2 when the first duration DR1 ends. The level counter 246 decreases the count value LC by one step at the second timing T2.

The second frame counter 244 starts to count the second number N2 of the frames at the second timing T2 when the second duration DR2 begins. The second frame counter 244 counts the second number N2 of the frames until the second number N2 reaches a second reference number Y. The level counter 246 holds the count value LC at +1 while the second frame counter 244 counts the second number N2.

The second frame counter 244 is reset at a third timing T3 when the second number N2 reaches the second reference number Y. The level counter 246 decreases the count value LC by one step at the third timing T3.

The second frame counter 244 starts to count the second number N2 of the frames at the third timing T3. The second frame counter 244 counts the second number N2 of the frames until the second number N2 reaches the second reference number Y. The level counter 246 holds the count value LC at 0 while the second frame counter 244 counts the second number N2.

The second frame counter 244 is reset at a fourth timing T4 when the second number N2 of the frames reaches the second reference number Y. The level counter 246 decreases the count value LC by one step at the fourth timing T4.

The second frame counter 244 starts to count the second number N2 of the frames at the fourth timing T4. The second frame counter 244 counts the second number N2 of the frames until the second number N2 reaches the second reference number Y. The level counter 246 holds the count value LC at −1 while the second frame counter 244 counts the second number N2 of the frames.

The second frame counter 244 is reset at a fifth timing T5 when the second number N2 of the frames reaches the second reference number Y. The level counter 246 decreases the count value LC by one step at the fifth timing T5.

The level counter LC may end the second duration DR2 and may begin the third duration DR3 when the count value LC reaches a limit count value which is −2 in FIG. 6.

The first frame counter 242 starts to count the first number N1 of the frames at a fifth timing T5 when the third duration DR3 begins. The first frame counter 242 counts the first number N1 of the frames until the first number N1 reaches the first reference number X. The level counter 246 holds the count value LC at −2 during the third duration DR3.

The first frame counter 242 is reset at a sixth timing T6 when the third duration DR3 ends. The level counter 246 increases the count value LC by one step at the sixth timing T6.

The second frame counter 244 starts to count the second number N2 of the frames at the sixth timing T6 when the fourth duration DR4 begins. The second frame counter 244 counts the second number N2 of the frames until the second number N2 reaches a second reference number Y. The level counter 246 holds the count value LC at −1 while the second frame counter 244 counts the second number N2.

The second frame counter 244 is reset at a seventh timing T7 when the second number N2 reaches the second reference number Y. The level counter 246 increases the count value LC by one step at the seventh timing T7.

The second frame counter 244 starts to count the second number N2 of the frames at the seventh timing T7. The second frame counter 244 counts the second number N2 of the frames until the second number N2 reaches the second reference number Y. The level counter 246 holds the count value LC at 0 while the second frame counter 244 counts the second number N2.

The second frame counter 244 is reset at an eighth timing T8 when the second number N2 of the frames reaches the second reference number Y. The level counter 246 increases the count value LC by one step at the eighth timing T8.

The second frame counter 244 starts to count the second number N2 of the frames at the eighth timing T8. The second frame counter 244 counts the second number N2 of the frames until the second number N2 reaches the second reference number Y. The level counter 246 holds the count value LC at +1 while the second frame counter 244 counts the second number N2 of the frames.

The second frame counter 244 is reset at a ninth timing T9 when the second number N2 of the frames reaches the second reference number Y. The level counter 246 increases the count value LC by one step at the ninth timing T9.

The level counter LC may end the fourth duration DR4 when the count value LC reaches a limit count value which is +2 in FIG. 6.

Operations in the first through fourth durations DR1, DR2, DR3, DR4 explained above may be repeated after the fourth duration DR4.

Exemplary embodiments of the present inventive concept provide a display apparatus capable of increasing display quality. Exemplary embodiments of the present inventive concept provide a method of driving the display apparatus.

According to exemplary embodiments of the present inventive concept, by dividing a plurality of frames into a holding duration and a changing duration and swinging a common voltage gradually during the changing duration, an afterimage can be reduced without a rapid change of the common voltage. Thus, display quality of the display panel can be increased.

The above described exemplary embodiments may be used in a display apparatus and/or a system including the display apparatus, such as a mobile phone, a smart phone, a personal digital assistant (PDA), a portable media player (PMP), a digital camera, a digital television, a set-top box, a music player, a portable game console, a navigation device, a personal computer (PC), a server computer, a workstation, a tablet computer, a laptop computer, a smart card, a printer, etc.

While the present inventive concept has been particularly shown and described with reference to exemplary embodiments thereof, it will be apparent to those of ordinary skill in the art that various changes in form and detail may be made thereto without departing from the spirit and scope of the present inventive concept as defined by the following claims.

What is claimed is:

1. A display apparatus, comprising:

a display panel configured to display an image;

a first frame counter configured to count a first number of frames during a first duration and to be reset when the first number of the frames reaches a first reference number;

a second frame counter configured to count a second number of the frames during a second duration and to be reset when the second number of the frames reaches a second reference number, wherein the second duration occurs after the first duration and is shorter than the first duration;

a level counter configured to hold a count value at a first count value during the first duration, to change the count value when the first frame counter is reset, and to change the count value when the second frame counter is reset; and a common voltage generator configured to control a level of a common voltage to correspond to the count value and to output the common voltage to the display panel, wherein the second duration begins when the second frame counter receives a reset signal from the first frame counter.

2. The display apparatus of claim 1, wherein the first frame counter and the second frame counter operate alternately.

3. The display apparatus of claim 1, wherein the first duration ends and the second duration begins when the first frame counter is reset.

4. The display apparatus of claim 1, wherein the second duration ends when the count value reaches a limit count value during the second duration.

5. The display apparatus of claim 1, wherein the level counter is configured to:

increase the count value when the second frame counter is reset during the second duration if the level counter increased the count value when the first frame counter was reset; and decrease the count value when the second frame counter is reset during the second duration if the level counter decreased the count value when the first frame counter was reset.

6. The display apparatus of claim 1, wherein the first and second frame counters are configured to count a number of the frames in response to a vertical start signal.

7. The display apparatus of claim 1, further comprising:

a frame count signal generator configured to generate a frame count signal in response to a data enable signal or a gate clock signal, wherein the first and second frame counters are configured to count a number of the frames in response to the frame count signal.

8. The display apparatus of claim 1, wherein the first frame counter is configured to count a third number of the frames during a third duration which occurs after the second duration and to be reset when the third number of the frames reaches the first reference number, wherein the second frame counter is configured to count a fourth number of the frames during a fourth duration which occurs after the third duration and to be reset when the fourth number of the frames reaches the second reference number, and wherein the level counter is configured to hold the count value at a second count value during the third duration and to change the count value when the second frame counter is reset during the fourth duration.

9. The display apparatus of claim 8, wherein the level counter is configured to:

decrease the count value when the first frame counter is reset during the third duration if the level counter increased the count value when the first frame counter was reset during the first duration, and increase the count value when the first frame counter is reset during the third duration if the level counter decreased the count value when the first frame counter was reset during the first duration.

10. The display apparatus of claim 9, wherein the second duration ends when the count value reaches the second count value during the second duration, and the fourth duration ends when the count value reaches the first count value during the fourth duration.

11. The display apparatus of claim 1, wherein the level counter is configured to change the count value during vertical blank durations between the frames.

12. The display apparatus of claim 1, wherein the first duration is more than two times longer than the second duration.

13. The display apparatus of claim 1, further comprising:

a mode controller configured to select one of a first mode and a second mode, wherein the level of the common voltage is held or changed according to an operation of the level counter in the first mode, and the common voltage has a reference common voltage level in the second mode.

14. The display apparatus of claim 1, further comprising:

a data driver configured to generate data voltages in response to input image data, wherein the display panel comprises a pixel electrode and a common electrode, wherein the data driver is configured to output the data voltages to the pixel electrode, and wherein the common voltage generator is configured to output the common voltage to the common electrode.

15. A method of driving a display apparatus, the method comprising:

outputting a data voltage in response to input image data;

counting a first number of frames and holding a count value at a first count value;

resetting counting of the first number of the frames and changing the count value when the first number of the frames reaches a first reference number;

counting a second number of the frames when the counting of the first number of the frames is reset and resetting counting of the second number of the frames when the second number of the frames reaches a second reference number, wherein the second number of the frames begins to be counted by a second frame counter in response to a signal provided from a first frame counter;

changing the count value when the counting of the second number of the frames is reset; and controlling a level of a common voltage to correspond to the count value and outputting the common voltage.

16. The method of claim 15, wherein changing the count value when the counting of the second number of the frames is reset comprises:

increasing the count value when the counting of the second number of the frames is reset if the count value was increased when the counting of the first number of the frames was reset, and decreasing the count value when the counting of the second number of the frames is reset if the count value was decreased when the counting of the first number of the frames was reset.

17. The method of claim 15, wherein counting the first and second numbers of the frames comprises:

counting the first and second numbers of the frames in response to a vertical start signal.

18. The method of claim 15, wherein counting the first and second numbers of the frames comprises:

generating a frame count signal in response to a data enable signal or a gate clock signal; and counting the first and second numbers of the frames in response to the frame count signal.

19. A method of driving a display apparatus, the method comprising:

outputting a data voltage in response to input image data;

holding a level of a common voltage at a first voltage level while a first frame counter counts a number of frames up to a first reference number during a first duration;

changing the level of the common voltage to a second voltage level during a second duration which occurs after the first duration, wherein the first duration ends and the second duration begins when the first frame counter is reset; and holding the level of the common voltage at the second voltage level while the first frame counter counts the number of the frames up to the first reference number during a third duration which occurs after the second duration, wherein the second duration ends when a second frame counter is reset by the first frame counter.

20. The method of claim 19, wherein changing the level of the common voltage comprises:

resetting the second frame counter and changing the level of the common voltage by one step when the second frame counter counts the number of the frames up to a second reference number during the second duration.

* * * * *